United States Patent [19]

Bradley

[11] Patent Number: 4,640,191

[45] Date of Patent: Feb. 3, 1987

[54] SUBLIMATION PRINTING APPARATUS

[76] Inventor: Gerald R. Bradley, c/o Packaging Systems Corporation, 317 S. Thomas Ave., Sayre, Pa. 18840

[21] Appl. No.: 765,272

[22] Filed: Aug. 13, 1985

[51] Int. Cl.[4] ..... B41M 5/035; F26B 3/22

[52] U.S. Cl. ..... 101/470; 34/41; 101/416 A; 8/471

[58] Field of Search ..... 101/470, 416 A; 34/41; 8/471

[56] References Cited

U.S. PATENT DOCUMENTS

| | | | |
|---|---|---|---|
| 1,266,735 | 5/1918 | White | 34/41 |
| 1,432,302 | 10/1922 | Reed | 34/41 |
| 2,137,480 | 11/1938 | Dye | 34/41 |
| 2,270,654 | 1/1942 | Johnson | 34/41 |
| 2,352,444 | 6/1944 | Miller | 34/41 |
| 3,289,573 | 12/1966 | Apicella | 101/27 |
| 3,619,103 | 11/1971 | Williams | 34/41 |
| 3,879,816 | 4/1975 | Monti | 101/470 |
| 3,986,823 | 10/1976 | Mayer | 101/470 |

*Primary Examiner*—Clyde I. Coughenour

[57] ABSTRACT

Apparatus for printing discrete patterns on a web of indefinite length comprising a printing station, a curing zone and a cutting station at which the web is cut into sections, each comprising the printed matter. The web is advanced stepwise and at the printing station the pattern is imprinted in one or more colors with a sublimable dye composition. The curing zone comprises a heated tower against the surfaces of which the web is pressed during movement of the web to cure the dye composition. Two pairs of rollers cooperate to cause the web to contact the tower surfaces during the web movement and to separate the web from such surfaces during printing and cutting of the web which is cut into sections at the cutting station after it leaves the tower. Control apparatus synchronizes the movement of the web with the printing, curing and cutting operations.

3 Claims, 6 Drawing Figures

SUBLIMATION PRINTING APPARATUS

This application is related to copending application Ser. No. 679,306, filed Dec. 7, 1984 in the name of Melvin J. Skerpon and entitled "Sublimation Printing".

This invention relates to apparatus for the manufacture of labels for garments and the like and in particular provides apparatus for printing such labels utilizing heat transfer printing, otherwise known as sublimation printing.

Product labels utilized in garments, such as name tags, cleaning instructions and the like, desirably should last the lifetime of the garment. Typically a washed garment may have to endure several hundred washings in its lifetime, and a garment which is dry cleaned might be required to endure dozens of cleanings in its lifetime. The abuse to which such labels are subjected during industrial washing and dry cleaning causes fading and eventual obliteration of conventionally printed labels; yet, printing of such labels is highly desirable because labels can be printed at much higher speeds than they can be woven.

It is therefore an important object of this invention to provide apparatus for high speed printing of discrete patterns and indicia on fabric in which the printed patterns and indicia are resistant to industrial washing and dry cleaning. In particular, it is also an important object of the invention to provide such an apparatus in which the printing on the fabric is in discrete patterns or indicia along an indefinite length of the fabric from which the discrete, printed portions of material can be subsequently separated for use as labels utilizing a quasi continuous printing process.

These and other objects of the invention are essentially obtained utilizing a sublimation printing apparatus in which the sublimable dye compositions used to print on the fabric are of the same character and composition as dyes used to print patterns on fabrics, such as double-knit polyester and the like.

Sublimation printing basically involves the transfer of a pattern printed on a transfer paper or foil with a sublimable dye composition from the foil to the surface of the fabric by the use of heat and pressure. In commercial sublimation printing, as practiced, the process is a continuous one with the transfer paper or foil being in the form of a strip of an indefinite length one surface of which carries the desired pattern in the form of a patterned coating of a sublimable dye composition. The coated surface of the transfer strip is brought into contact with the fabric as both are simultaneously drawn through heated pressure devices such as rolls to transfer (print) the pattern to the surface of the fabric. To perfect the transfer of the patterned coating of sublimable dye composition to the fabric, the printed fabric is then carried through a curing operation in which the fabric is heated to sublime the dye composition and set it permanently on the fabric surface.

In the apparatus of the present invention, sublimation printing is utilized to manufacture discrete pieces of fabric having discrete patterns or indicia printed thereon by passing a web of an indefinite length of fabric through a printing station where the pattern is transferred from a strip of transfer foil to a surface of the fabric. Thereafter the fabric web is passed through a curing zone in which the fabric is heated to a temperature to effect setting of the sublimable dye composition, and then the fabric web is passed to a cutting station in which the discrete, printed portions of the fabric are separated, for example, by hot knife cutting.

The passage of the fabric web through the printing station, curing zone and cutting station is with a periodic advance and pause in movement, the pause being timed in both the printing operation and the cutting operation so that simultaneously as the dye composition is transferred to the web at the printing station a discrete printed portion of the web is separated from the web at the cutting station.

An important feature in accordance with the present invention is the transfer of the sublimable dye composition by pressing with a printing surface on which the patterns and/or indicia to be printed are formed in relief. Thus, in accordance with this invention, the strip of transfer foil has a continuous rather than a patterned coating of sublimable dye composition on one side such that when the printing surface is pressed to bring the coated side of the transfer foil against a surface of the fabric web a pattern or indicia is transferred from the coated surface of the transfer foil to the surface of the web corresponding to the pattern or indicia formed on the printing surface The printing surface should be heated to a temperature causing release of the sublimable dye composition from the transfer foil. Such temperature is normally less than the sublimation temperature of the dye composition and typically can be 250° F. to 350° F.

In a more particular aspect of this invention, it is contemplated that the strip of transfer foil be moved coincident in timing of advance and pause with the fabric web, as the transfer strip confronts and is adjacent to the fabric web at the printing station. Preferably, the transfer strip is at a transverse angle in direction of movement with respect to the direction of movement of the fabric web, and preferably 90° with respect to the web. Such transverse movement has two advantages. Namely, it permits more than one color printing, since more than one transfer strip can be utilized if the movement is transverse to that of the web, and considerably less space is occupied longitudinally by the printing station.

Preferably the strip of transfer foil is in the form of a film of polypropylene, which has been found to give exceptionally clean impressions on transferring patterns and indicia from a continuously coated surface of a transfer strip by means of patterns and indicia formed in relief on the printing surface.

In carrying out the present invention, the sublimable dye compositions are generally those used commercially in printing fabrics, such as double-knit polyesters and the like. These compositions can have sublimation temperatures running between 125° F. and 475° F. and, more typically between about 390° F. and 460° F. Hence, the curing zone should bring the temperature of the fabric to the sublimation temperature of the dye composition, as limited by the temperatures to which the fabric can be subjected. The length of time in the curing zone should be sufficient to effect the setting of the dye composition and is conventional.

For a more complete understanding of the practical application of this invention, reference is made to the appended drawings in which:

FIG. 1 is a schematic diagram illustrating the apparatus of this invention for printing discrete patterns and indicia on a web of fabric and separating the patterns into individual labels or the like;

Figure 1:
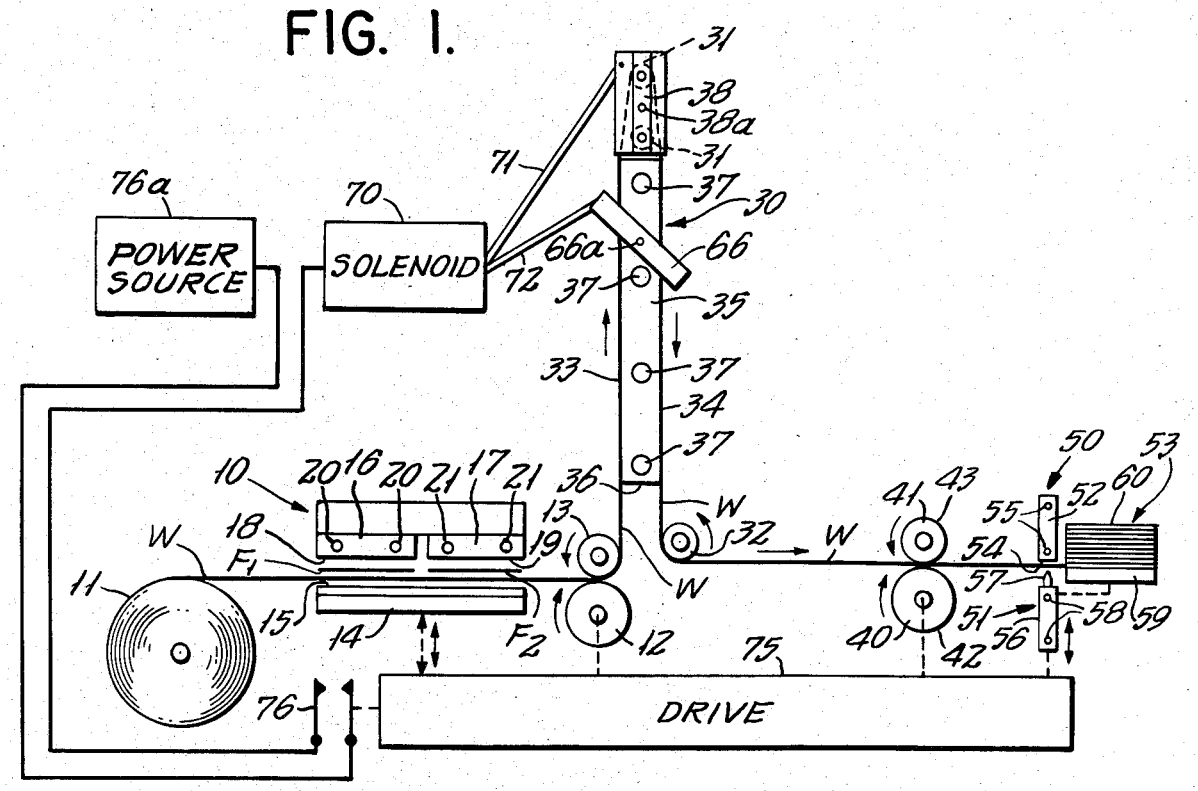

Referring more particularly to FIG. 1, an apparatus of the invention suitable for carrying out the printing process basically includes a printing station, generally designated by the reference numeral 10, a curing tower 30, and a cutting station 50. A web W of fabric is fed lengthwise in sequence through printing station 10, curing tower 30 and cutting station 50. The web W is initially paid off from a spool 11 from which it is passed in a horizontal direction through printing station 10. Web W then passes between cooperating feed roller 12 and pressure roller 13 and is turned in direction about pressure roller 13 upwardly in a vertical direction about one side 33 of curing tower (to the left as seen in FIG. 1), about a pair of stripper rollers 31 and then downwardly along the other side 34 (to the right in FIG. 1) of tower 30 from which it is taken off in a horizontal direction about turn roller 32. Web W is then drawn horizontally from turn roller 32 between an auxiliary feed roller 40 and cooperating auxiliary pressure roller 41 into cutting station 50.

Figure 5:
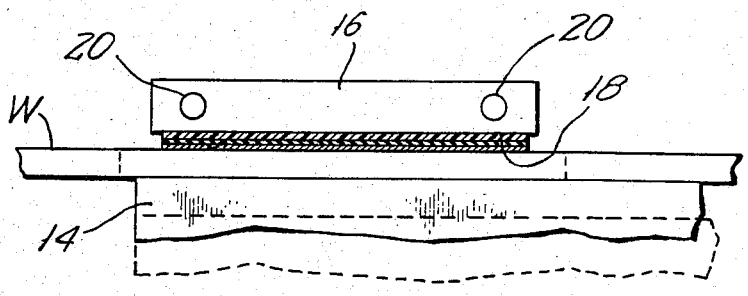
FIG. 5 is an enlarged fragmentary, longitudinal section taken through a portion of FIG. 1.

Printing station 10, through which FIG. 5 is a section, includes a vertically reciprocable, lower impression bed 14 having a flat horizontal upper surface 15 formed of hard elastomer in fixed position such that web W slides across surface 15 in passing from payoff spool 11 to main rollers 12 and 13.

Printing station 10 further includes a pair of printing platens 16 and 17. Platens 16 and 17 are mounted above impression bed 14 spaced slightly apart with their respective under surfaces 18 and 19 positioned horizontally. The impression bed 14 is movable from a lower position, shown in dotted lines in FIG. 5, to an upper position, shown in solid lines in FIG. 5, to press the web W against the printing platens 16 and 17. Under surfaces 18 and 19 of the platens 16 and 17 are etched or otherwise relieved in a conventional manner to provide the patterns or indicia which are to be printed on web W. Desirably the patterns are arranged for printing two different colors, such as red with platen 16 and black with platen 17, which are transferred, in the raised position of the bed 14 from a foil F1 interposed between under surface 18 and web W and a foil F2 interposed between under surface 19 and web W. As described more completely hereinafter, with reference to FIGS. 4, 5 and 6, foils F1 and F2 are in strip form and are fed, as indicated more completely in FIG. 4, from payoff spools (not shown) transversely across the path of movement of web W.

Platens 16 and 17 are internally provided with heating elements 20 and 21, respectively, which can be electrical resistance heating elements or conduits for circulation of heated fluid and are thermostatically controlled to permit maintenance of platens 16 and 17 at an elevated temperature up to 500° F.

Main feed roller 12 is a knurled aluminum cylinder mounted for rotation about a horizontal axis adjacent impression bed 14 at the end of bed 14 opposite payoff spool 11. The axis of rotation of roll 12 is parallel to that of spool 11, and upperside of roll 12 is tangent to the plane of the upper surface 15 of impression bed 14 such that web W passing from payoff spool 11 slides across surface 15 and passes over roll 12.

Pressure roller 13 is a metal cylinder and is mounted for free rotation about a horizontal axis vertically aligned above the axis of rotation of feed roller 12 such that surface 22 of pressure roller 13 bears downwardly against roller 12 to grip web W firmly between rollers 12 and 13. Roller 12 is driven clockwise, as seen in FIG. 1 to draw web W from payoff spool 11 across impression bed 14.

Curing tower 30 includes an elongated metal plate 35 having flat parallel elongated sides 33 and 34 positioned vertically with a bottom edge 36 located just above and to the right of pressure roller 13 such that the plane of the side 33 is vertically tangent to the right side of pressure roller 13, as seen in FIG. 1. Internally, plate 35 is provided with heating elements 37 which can be electrical resistance heating elements or conduits for circulation of heated fluid. Heating elements 37 are thermostatically controlled such that the temperature of plate 35 can be maintained at an elevated temperature up to 500° F.

Stripper rollers 31 are a pair of metal cylinders mounted on a frame 38 which normally positions rollers 31 vertically one above the other and aligned with plate 35. Rollers 31 are mounted in frame 38 for rotation about horizontal axes and have a diameter smaller than the thickness of plate 35 such that web W brought up in contact with surface 33 of plate 35 turns about the upper roller 31 and then downwardly in contact with side 34 of plate 35. Frame 38 in which rollers 31 are mounted for free rotation is also rotatable about a horizontal axis 38*a* centered between the rotational axes of rollers 31. A solenoid actuated mechanism, operated by a solenoid 66 and described in further detail hereinafter, is provided to rotate frame 38 about such horizontal axis 38*a* between a normal position in which stripper rollers are vertically aligned, as shown in FIG. 1, and a stop mode position in which frame 38 is rotated through 90° such that rollers 31 are horizontally aligned.

Figure 3:
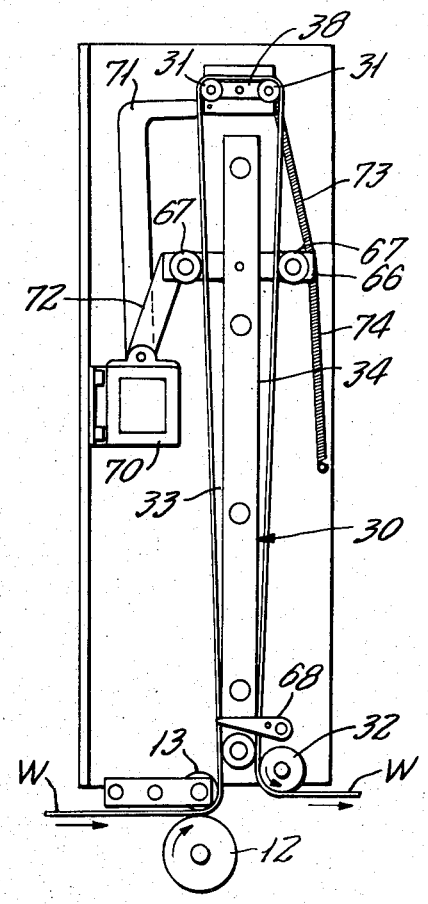
FIG. 3 is similar to FIG. 2 and illustrates the operation of such portion of the apparatus in a stop mode.

In the stop mode, the position of rollers 31 is such that the cylindrical surface of one extends outwardly beyond the plane of side 33, to the left as seen in FIG. 1, and the other roller 31 extends outwardly beyond the plane of side 34, to the right as seen in FIG. 1, such that web W is lifted away from sides 33 and 34, as may be seen more clearly in FIG. 3.

Web W is held in contact with sides 33 and 34 of plate 35 by hold-down rollers carried by a pivotable frame 66, similar to the frame 38, and by turn roller 32 and pressure roller 13 when stripper rollers 31 are positioned vertically in their normal position. Turn roller 32 is a metal cylinder mounted for free rotation about a horizontal axis with its cylindrical surface adjacent to the lower end of plate 35 almost tangent to the plane of side 34.

Web W is drawn about tower 30 from rollers 12 and 13 and horizontally away from turn roller 32 (to the right as seen in FIG. 1) by auxiliary knurled aluminum feed roller 40 in combination with auxiliary metal pressure roller 41.

Feed roller 40 is a cylinder having a peripheral surface 42 and is mounted beneath roller 41 with its surface 42 substantially in contact with the knurled peripheral surface 43 of the pressure roller 41. Rollers 40 and 41 have parallel horizontal axes positioned transversely to web W. Feed roller 40 is driven clockwise, as seen in FIG. 1, and pressure roller 41 is mounted in free rotation such that it is driven by contact with the web W. Rollers 40 and 41 are so located that web W passes horizontally from the underside of turn rollers 32 and between the contacting surfaces 42 and 43.

Cutting station 50 includes a hot knife mechanism 51 which cooperates with a cold anvil 52 and a stacking unit 53. Anvil 52 is a metal plate, the bottom surface 54 of which is flat, horizontal and positioned across and immediately above the path of travel of web W as it is passed from rollers 40 and 41 (to the right as seen in FIG. 1). Anvil 52 is provided internally with conduits 55 or the like for circulation of a coolant fluid utilized to maintain the temperature of anvil 52 substantially below the softening temperature of web W, and preferably at or about the ambient temperature, i.e., about 70° or 80° F.

Hot knife 51 includes a plate 56 which is mounted for vertical reciprocation beneath the path of travel of web W, immediately under anvil 52, and carries a knife blade 57 across its upper end which is positioned such that in a lower position of plate 56, blade 57 is spaced below anvil under surface 54 to permit free travel of web W between hot knife unit 51 and anvil 52. In a raised position of plate 56, blade 57 contacts under surface 54 of anvil 52 transversely across the position of web W. Plate 56 is provided with heating elements 58 which can be electrical resistance heaters or conduits for circulation of a heated fluid and which are thermostatically controlled at an elevated temperature sufficient to melt the polyester or other fabric material forming web W , e.g. 800°-840° F.

Stacking unit 53 includes a vertically reciprocable horizontal bed plate 59 having a normal, lower position immediately beneath the path of travel of web W as it passes between knife 51 and anvil 52 when these are parted. Bed plate 59 is commonly mounted with the hot knife 51 to be vertically reciprocated to a raised position slightly above the path of travel of web W when blade 57 strikes anvil surface 54.

Figure 4:
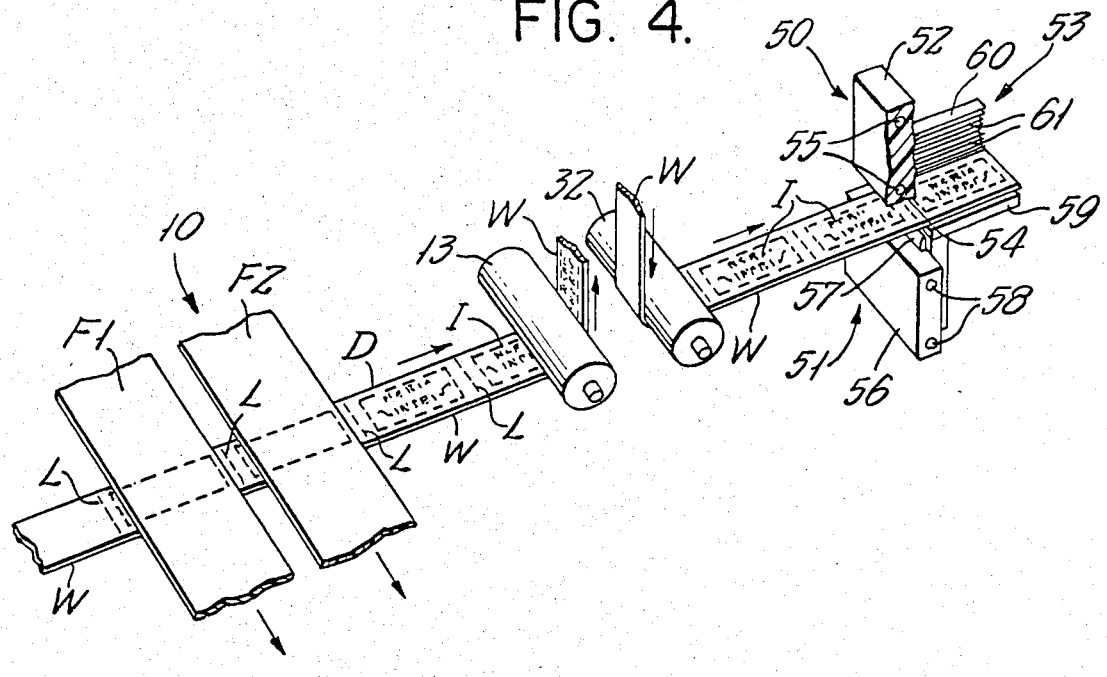
FIG. 4 is a fragmentary, perspective, diagrammatic view, with parts omitted, illustrating the synchronization of movement in carrying out the process of this invention.

Stacking unit 53 further includes a pair of fixed side walls 60, only one of which is shown in FIG. 4, which are mounted in fixed position on opposite sides of the path of travel of web W across bed plate 59 such that as web W passes through parted anvil 52 and knife 51, the longitudinal edges of web W are in loose, sliding contact with the inner faces of confronting walls 60. These confronting faces of walls 60 are further provided with horizontal ledges 61 which extend inwardly from walls 60 such that the spacing between confronting ledges 61 is slightly less than the transverse dimension of web W. The vertical reciprocation of bed plate 59 is such that a cut section D of web W positioned on bed plate 59 is carried upwardly by vertical upward movement of bed plate 59 to a position with the edges of web W received just above the lowermost pair of confronting ledges 61. Thus, as bed plate 59 is withdrawn downwardly, section D of web W will be retained by ledges 61 in a raised position between confronting walls 60 of stacking unit 53.

An essential part of the operation of the apparatus shown in the accompanying drawings resides in the timing of the various movements of feed rollers 12 and 40, of bed 14, of foils F1 and F2 and of hot knife 51 and bed plate 59. This timing is best illustrated with reference to FIG. 4. The movement of web W through the apparatus is with periodic advance and pause such that the length of the advance of web W is equal to a discrete section D to be printed. In FIG. 4 each discrete section D is shown separated by a broken line L across web W and carries centered on it printed indicia I (following passage through printing station 10) which are schematically indicated on each section D.

The spacing of platens 16 and 17 is such that in one advance between pauses of web W a discrete section D is carried from a position centered beneath platen 16 to a position centered beneath platen 17. Further, the location of hot knife 51 is such that on each pause of web W one of lines L is positioned immediately above the edge of blade 57 at cutting station 50. Further, the length of bed plate 59 is such that it receives a discrete section D. The time of pause in advance of web W is sufficient for an upward printing stroke of the bed 14. At the same time hot knife 51 and bed plate 59 are reciprocated together upwardly such that the section D of web W on bed plate 59 is severed and carried upwardly to be wedged between confronting ledges 61 of walls 60. Subsequent operation of the unit adds further sections D to form a stack retained between walls 60.

The timing is further such that, while web W is advanced with bed 14 withdrawn downwardly, foils F1 and F2 are also advanced to bring fresh unused portions of foils F1 and F2 beneath platens 16 and 17. The movement of foils F1 and F2 is also with advance and pause which is coincident with that of web W such that not only web W but foils F1 and F2 also are stationary when bed 14 is brought upward to print web W.

To prevent overheating of the web W during its passage around the tower 30, the web W engages the surfaces 33 and 34 of the tower 30 only during the advance of the web W, and the web W is moved away from the surfaces by the rollers 31 on the frame 38 during the pause in the advance of the web W. However, during the advance of the web W, the web W is held in contact with the surfaces 33 and 34 by hold down rollers 67 (see FIGS. 2 and 3) rotatably mounted on the frame 66 which is pivotable about an axis **66*a*. The web W is also held against the lower end of the surface 34 by a web guide 68. The pivoting of the frames 38 and 66** is synchronized with the advancing and pausing of the web W as described hereinafter.

Figure 2:
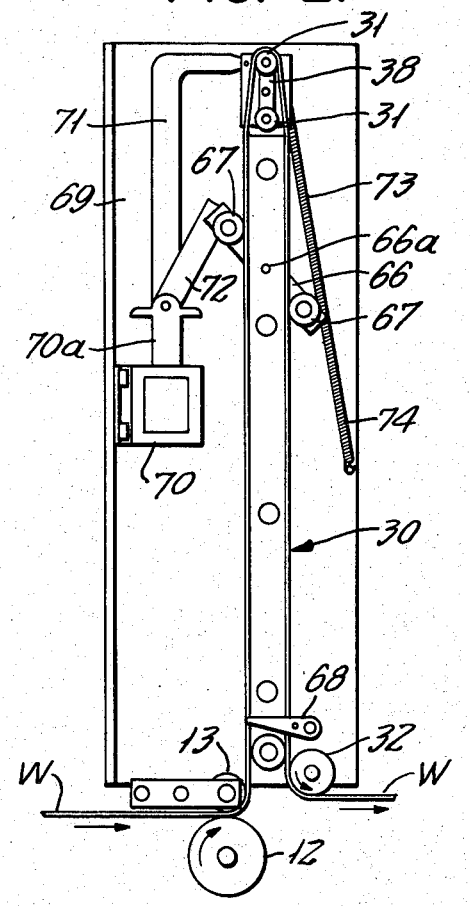
FIG. 2 is a diagrammatic, fragmentary, side elevation view of a portion of the apparatus diagrammatically indicated in FIG. 1.

Although other methods of pivoting the frames 38 and 66 may be employed, apparatus which may be used to pivot such frames is illustrated in FIGS. 2 and 3, FIG. 2 illustrating the positions of the frames 38 and 66 during the advance of the web W and FIG. 3 illustrating the positions of the frames 38 and 66 during a pause in the advance of the web W.

As illustrated in FIGS. 2 and 3, the tower 30 is mounted on a frame 69 on which an electrically operable solenoid 70 is mounted. The armature **70*a* of the solenoid 70 is connected to the frame 38 by a link 71 which is pivotally connected at its ends to the armature 70*a* and the frame 38. The armature 70*a* is similarly connected to the frame 66 by a link 72. When the solenoid 70 is not energized, the frames 38 and 66 are pulled into the positions shown in FIG. 2 by springs 73 and 74 in an obvious manner. When the solenoid 70 is energized, the armature 70*a* is pulled into the solenoid 70 and by means of the links 71 and 72, pivots the frames 38** and 66 into the positions shown in FIG. 3. Thus, when the web W is being advanced, the solenoid 70 is not energized, the rollers 31 are in positions which permit the web W to engage the surfaces 33 and 34 and the rollers 67 are in positions in which they engage the web W and urge it against the surfaces 33 and 34. When the advance of the web W is stopped, the solenoid 70 is energized, the rollers 67 are moved away from the surfaces 33 and 34 and permit the web W to move away from the surfaces 33 and 34 and the rollers 31 are moved into positions in which they move with the web W away from the surfaces 33 and 34.

Although other methods of synchronizing the movement of the web W and the operation of the various parts may be used, one form of control apparatus is illustrated diagrammatically in FIG. 1. As illustrated therein, the frames 38 and 66 are connected to the solenoid 70, and the bed 14, the feed rollers 12 and 40 and the knife 57 are connected to a conventional mechanical drive 75 which operates the bed 14, the feed rollers 12 and 40, and the knife 57 and bed plate 59 in the manner described. The drive 75 for such parts also operates a switch 76 which controls the energization of the solenoid 70 from the electrical power source 76. The contacts of the switch 76 are closed when the drives are not moving the web W.

The drive 75 contains linkages, cams, crankshafts, etc., which periodically, and alternately, operate the feed rollers 12 and 40 with the switch 76 for the required period of time open, the bed 14 in its downward position and the knife 57 and the bed plate 59 in their downward positions and then, stops the feed rollers 12 and 40, closes the switch 76 and moves the bed 14, the knife 57 and the bed plate 59 upwardly.

Figure 6:
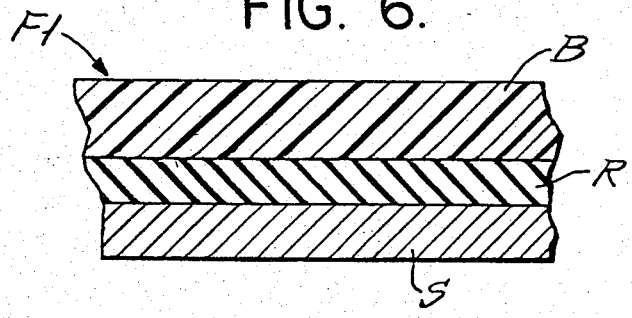
FIG. 6 is an enlarged fragmentary section of a strip of transfer foil.

As can be seen more clearly with reference to FIG. 6, which is a cross-section through foil F1, and also typifies foil F2, the foil includes a backing B of paper or other transfer matrix material. Backing B in the illustrated case preferably is polyproplylene film. Backing B is provided with a release coating R on its under side and a coating S of sublimation dye composition on the underside of release coating R.

Referring more particularly to FIG. 5, a transfer foil, such as foil F1, is positioned beneath a printing plate, such as printing plate 16, and the coating S of sublimation dye composition on the underside of foil F1 is positioned facing the upper surface of web W. When bed 14 is moved upwardly from its lower position shown in dotted lines in FIG. 5, the under surface 18 is brought into contact with backing B of foil F1, as shown in solid lines in FIG. 5. The temperature of platen 16 and the length of time of contact during the pause and advance of web W and foil F1 is sufficient to enable transfer of those portions of coating S of sublimation dye composition which coincide with the indicia or other patterns formed on the under side of platen 16. Thus, the indicia are removed from coating S of foil F1 and deposited on web W, as indicated by the reference letter I in FIG. 4.

Web W with the thusly imprinted discrete sections D is carried from printing station 10, as described above, through curing tower 30. As suggested above, the printing operation requires two pauses in advance of web W, one to print one color utilizing foil F1 and platen 16 and the second pause to print a second color utilizing foil F2 and platen 17. The use of a second color printing station can of course be eliminated if a single color label is all that is required. In either event the length of tower 30 and the temperature to which it is heated are such that, as web W is advanced upwardly in contact with side 33 and downwardly in contact with side 34 of plate 35, the indicia I printed on each discrete section D of web W are brought to a sufficient temperature to sublimate the dye composition and set it.

From an apparatus standpoint, great economics in space are achieved utilizing a vertical curing tower as this greatly reduces the horizontal run which would otherwise be required. In addition, the rotatable frame 38 utilized to position stripper rollers 31 permits stopping the operation of the unit while plate 35 is heated, for example, to change to fresh rolls of foil, such as foils F1 and F2, or to remove a stack of finished labels, since the rotation of stripper rollers 31 to a horizontal alignment moves web W away from plate 35 and hence from the source of heat. If web W were stopped in contact with plate 35, as it is in normal operating mode, web W would be overheated causing deterioration of the web material and overcure of the printed indicia I.

EXAMPLE

A 100% polyester woven fabric, scoured and heat set, 118×50 construction in tape form was backcoated to give it suitable hand with a urethane based backcoating utilizing a standard floating knife technique. Care was taken to prevent strike-through of any coating material to the face of the tape as this would have interfered with proper development and retention of subsequent print on the face of the tape. The tape was further edge fused after coating and was mounted on spool 11 to function as web W in the process described above. The uncoated face of the tape was exposed on spool 11 such that it faced upwardly when drawn across impression bed 14.

A single foil F1 was utilized at printing station 10 mounted to travel underneath platen 16 above web W. Foil F1 formed of 1.5 mil polypropylene film having a 3 inch width. Foil F1 was prepared on a two-color Champlain rotogravure press. A release coat of microcrystalline wax in a vehicle, ELVEX 150, a proprietary product, was applied at the first printing station in the press, and a black sublimation ink coating of SUB-LI-DYE BLACK 39-893, a proprietary product, was applied at the second printing station of the rotogravure press. The process of coating the foil used standard printing methods such as are utilized in preparing foil for hot stamping techniques. Thus, foil F1 comprised a backing B of polypropylene with a release coating R of microcrystalline wax and a sublimation dye coating S of black ink.

The polyester tape was threaded through the apparatus, as shown in FIG. 1 for web W, past auxiliary rollers 40 and 41, with its end extending between anvil 52 and hot knife 51. Stripper rollers 31 and hold-down rollers 67 were positioned in horizontal alignment, as shown in FIG. 3, and plate 35 was heated to a temperature of approximately 400° F. Platen 16 was heated to a temperature of 275° F.–300° F., and hot knife 51 was heated to bring blade 57 to a temperature which when pressed against web W would cut through web W by fusing the polyester without charring. Anvil 52 was cooled by circulation of water at room temperature. Platen 17 was disabled so that it would not print on the web W and the drive for rollers 12 and 40 was set to advance web W 4 inches between pauses at a rate of 92 pauses per minute. The length of heated surfaces 33 and 34 was 30 inches.

When the mechanism was started up, to pull web W through the apparatus, stripper rollers 31 were rotated on frame 38 into vertical alignment, as shown in FIG. 1, bringing web W into sliding contact with surfaces 33 and 34. As plate 16 hot stamped an impression of indicia in 4 inch discrete sections from its under surface 18 onto the surface of W, as indicated by the reference letter I, the thusly printed sections D were carried about curing tower 30 with contact of the back surface of web W with heated plate 35 for a residence time of 4.9 seconds.

On each pause in advance of web W the finished sections D were separated along the lines indicated by reference letter L by the action of hot knife blade 57 striking through web W to anvil surface 54. At the same time separated sections D were stacked between walls 60 wedged on ledges 61 by the upward movement of bed plate 59. As bed plate 59 was withdrawn downwardly and blade 57 removed from contact with under surface 54 of anvil 52, the newly severed section D was thus positioned out of the path of travel of the end of web W subsequently passing hot knife 51 and anvil 52 on the following advance of web W.

During such following advance of web W a fresh section of foil F1 was passed over the upper surface of web W at printing station 10.

Although preferred embodiments of the present invention have been described and illustrated, it will be apparent to those skilled in the art that various modifications may be made without departing from the principles of the invention.

The embodiments of the invention in which an exclusive property of privilege is claimed are defined as follows:

1. Apparatus for printing discrete, separated patterns or indicia on a web of indefinite length, said apparatus comprising:

a printing station having printing means for printing a pattern or indicia on said web;

a heating tower for receiving and heating the web on which a pattern or indicia has been printed, thereby, curing said pattern or indicia;

stepping means for periodically moving said web stepwise past said printing means and said heating tower;

web control means adjacent said heating tower for contacting said web with surfaces of said tower during movement of said web and for separating said web from said surfaces during pauses in movement of said web;

said web control means comprising a pair of spaced rollers mounted adjacent one end of said heating tower for transferring said web from one side of said tower to the other side thereof, said rollers being spaced from each other by a distance greater that the distance from said one side of said tower to said other side thereof and being pivotable from a first position in which a plane containing the axis of said rollers is parallel or substantially parallel to the length of said tower and to a second position in which said plane extends transversely to the length of said tower, whereby in said first position of said rollers, said web contacts said surfaces of said tower and in said second position of said rollers, said web is spaced from said surfaces; and control means for synchronizing the operation of said printing means, said stepping means and said web control means so that said printing means prints said pattern or indicia and separates said web from said surfaces during intervals between movement of said web by said stepping means and operates said web control means to cause said web to contact said surfaces during movement of said web by said stepping means.

2. Apparatus as set forth in claim 1 wherein said web control means comprises a further pair of rollers, one of said further pairs of rollers being disposed at one side of one of said surfaces of said tower and the other of said further pair of rollers being disposed at one side of the other of said surfaces and means for moving said further pair of rollers toward and away from said surfaces for alternately pressing said web against said surfaces and permitting said web to move away from said surfaces.

3. Apparatus as set forth in claim 2 wherein the first-mentioned pair of rollers is mounted on a first pivotable frame and said further pair of rollers is mounted on a second pivotable frame and wherein said web control means comprises means for pivoting said first frame and said second frame connected to said control means.

* * * * *